US008657536B2

(12) United States Patent
Koos et al.

(10) Patent No.: US 8,657,536 B2
(45) Date of Patent: Feb. 25, 2014

(54) TENSIONING A RISER

(75) Inventors: John Dale Koos, Houston, TX (US); Kim Michael Carruthers, New Brunswick (CA)

(73) Assignee: MHD Offshore Group LP, Houston, TX (US)

( * ) Notice: Subject to any disclaimer, the term of this patent is extended or adjusted under 35 U.S.C. 154(b) by 142 days.

(21) Appl. No.: 13/052,517

(22) Filed: Mar. 21, 2011

(65) Prior Publication Data

US 2011/0170955 A1 Jul. 14, 2011

(51) Int. Cl.
*E21B 19/00* (2006.01)
*E02B 17/00* (2006.01)

(52) U.S. Cl.
USPC ..... 405/224.4; 166/355

(58) Field of Classification Search
USPC ..... 405/199, 224, 224.2, 224.3, 224.4; 166/355
See application file for complete search history.

(56) References Cited

U.S. PATENT DOCUMENTS

| | | | | |
|---|---|---|---|---|
| 4,733,991 | A * | 3/1988 | Myers | 405/224.2 |
| 4,883,387 | A * | 11/1989 | Myers et al. | 405/224.4 |
| 6,260,625 | B1 * | 7/2001 | Phan et al. | 166/355 |
| 7,329,070 | B1 | 2/2008 | Trent et al. | |
| 7,632,044 | B2 | 12/2009 | Pallini et al. | |
| 2005/0147473 | A1 | 7/2005 | Pallini et al. | |
| 2008/0304916 | A1 * | 12/2008 | Crotwell et al. | 405/224.2 |
| 2009/0145611 | A1 * | 6/2009 | Pallini et al. | 166/355 |
| 2010/0143047 | A1 | 6/2010 | Pallini et al. | |
| 2012/0207550 | A1 * | 8/2012 | Aksel et al. | 405/224.4 |

* cited by examiner

*Primary Examiner* — David Bagnell
*Assistant Examiner* — Kyle Armstrong
(74) *Attorney, Agent, or Firm* — Fish & Richardson P.C.

(57) ABSTRACT

A riser tensioner system for tensioning a riser at an offshore vessel includes a frame adapted to affix to the vessel. An elongate riser joint is provided for coupling into the riser. The riser joint has an axial flange portion projecting laterally outward therefrom from and extending axially along a length of the riser joint. Ram pistons are arranged about the frame to couple to the riser and to support the riser in tension. Centralizer arms are arranged on the frame to extend into proximity to the flange portion of the riser joint when the riser joint is received through the frame.

21 Claims, 3 Drawing Sheets

TENSIONING A RISER

BACKGROUND

In many instances, an offshore vessel connects with a riser extending from an underwater installation, such as a subsea well or manifold at the sea floor. The vessels move up and down and horizontally relative to the sea floor with the oscillations of the waves, currents, tides, winds and other environmental loading. The mechanism supporting the riser at the vessel maintains relatively constant tension on the riser during these oscillating movements. Riser tensioners, such as ram type tensioners (which push up on the riser from below) and hanging type tensioners (which pull up on the riser from above), may be used to support the riser tension and counteract movement of the vessel.

SUMMARY

The present disclosure relates to a ram type riser tensioner that maintains tension on a riser to an offshore vessel. In a general aspect, movements of the offshore vessel caused by waves, current, tides, wind and other environmental loading affect the relative position between the riser and the offshore vessel. The riser tensioner is therefore used to hold the riser in place relative to the offshore vessel while compensating for this movement.

Certain aspects encompass a riser tensioner system for tensioning a riser at an offshore vessel. The system includes a frame adapted to affix to the vessel and that defines a riser receiving opening. An elongate riser joint is provided for extending through the riser receiving opening of the frame. The riser joint has a tubular flow portion adapted to sealingly couple to a remainder of the riser and communicate fluid flow with the remainder of the riser. The riser joint also has an elongate axial flange portion projecting laterally outward from the tubular flow portion. The flange extends axially along a length of the riser joint. A plurality of ram pistons are arranged about the riser receiving opening and are coupled to the frame. The ram pistons are adapted to couple to the riser and be pressurized to extend axially to support the riser in tension. A plurality of centralizer arms are coupled to the frame and extend into proximity to the flange portion of the riser joint when the riser joint is received through the riser receiving opening.

Certain aspects encompass a method of supporting a riser relative to an offshore vessel. According to the method, an outer surface of the riser is gripped and an upward force relative to the vessel is applied, maintaining the riser in tension as the offshore vessel moves in response to environmental loading. An elongate, axial flange portion of the riser that protrudes laterally outward is engaged and used in maintaining the lateral location of the riser relative to the vessel.

Certain aspects encompass a riser tensioner for tensioning a riser of the type having a laterally protruding, axial flange. The riser tensioner includes a frame adapted to couple to a vessel. A ram piston is coupled to the frame, and is adapted to couple to the riser. The piston is pressurized to extend axially and apply an upward force to the riser along a longitudinal axis of the riser to retain the riser in tension. A centralizer protrudes from the frame and is adapted to abut the flange of riser and maintain the riser in a specified position relative to the frame.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
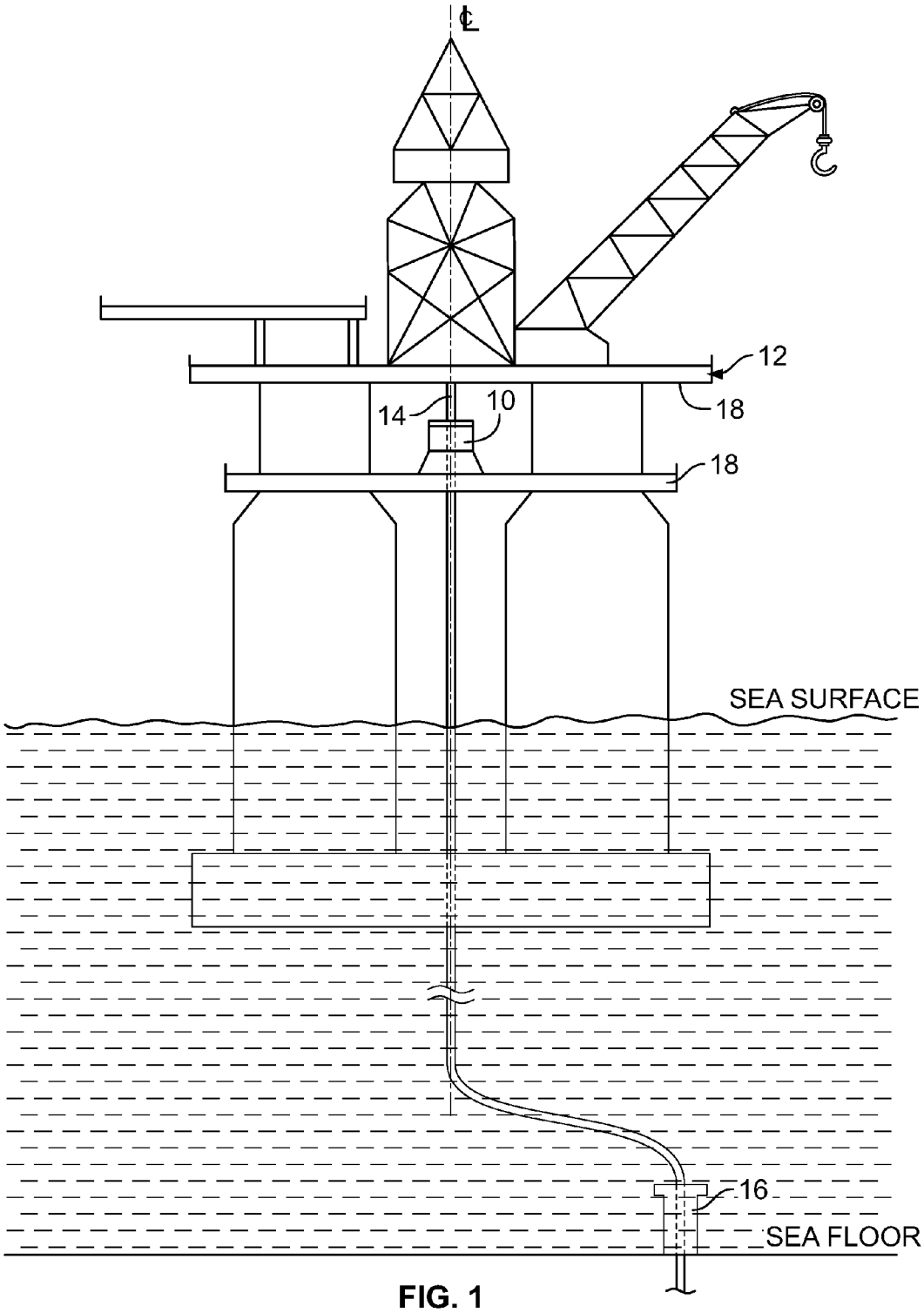
FIG. 1 is a schematic view of a riser tensioner system installed on an offshore vessel.

Referring first to FIG. 1, a ram riser tensioner system 10 is shown installed on an offshore vessel 12. The tensioner system 10 grips a riser 14 and provides a constant upward force on the riser 14 to support the riser 14 relative to the vessel 12 as the vessel 12 moves in response to waves, current, tides, wind and other environmental loading applied to the vessel 12.

The riser 14, extending between well equipment 16 on the sea floor and the vessel 12 is tubular, continuous or jointed tubing. In operation, it communicates fluid between the vessel 12 and the subsea well equipment 16. The subsea well equipment 16 can be a subsea wellhead, production tree, manifold and/or other equipment.

The vessel 12 can be any facility, platform or vehicle at the surface of a body of water, either floating or supported by structure beneath, for the purpose of drilling, production, well service and/or other operation. In certain instances, the vessel 12 can be a drill ship or other service ship, a semi-submersible platform, a tensioned leg platform (TLP), and other types of vessels. The vessel 12 can be deployed or installed offshore in the open sea, in a lake, or in another body of water. The vessel 12 can have multiple levels or decks 18 (two shown). The riser tensioner system 10 can be affixed to at or about one of the decks 18, for example, to the substructure of the vessel and/or otherwise. The riser 14 extends upward from underwater (e.g., subsea) well equipment 16 through an opening in the deck 18 to the riser tensioner system 10.

The riser tensioner system 10 is a ram type system, meaning that the riser tensioner system 10 pushes up on the riser 14 from below. Stated differently, the piston rods of the riser tension system 10 are experiencing compressive stresses during operation, unlike a tension type riser tensioner, of which its piston rods experience tensile stresses, or other types of riser tensioners that use wires, cables, winches or other mechanical devices to provide tension to the riser.

The vessel 12 experiences different environmental effects that cause movement in both translational and rotational directions. Typically, the vessel 12 would heave up and down, pitching, rolling and yawing with waves of the water, current, tides, wind and other environmental loading. The riser tensioner system 10 is configured to compensate for such movements of the vessel 12 by extension or retraction of the ram pistons, maintaining tension in an acceptable range to avoid buckling or over-extending the riser 14. For example, when the vessel 12 moves relatively downward, the tensioner system 10 will extend to prevent compressive overload and the subsequent buckling of the riser 14. When the vessel 12 moves relatively upward, the tensioner system 10 will retract to avoid tension overload and the consequent yielding deformation of the riser 14.

Figure 2:
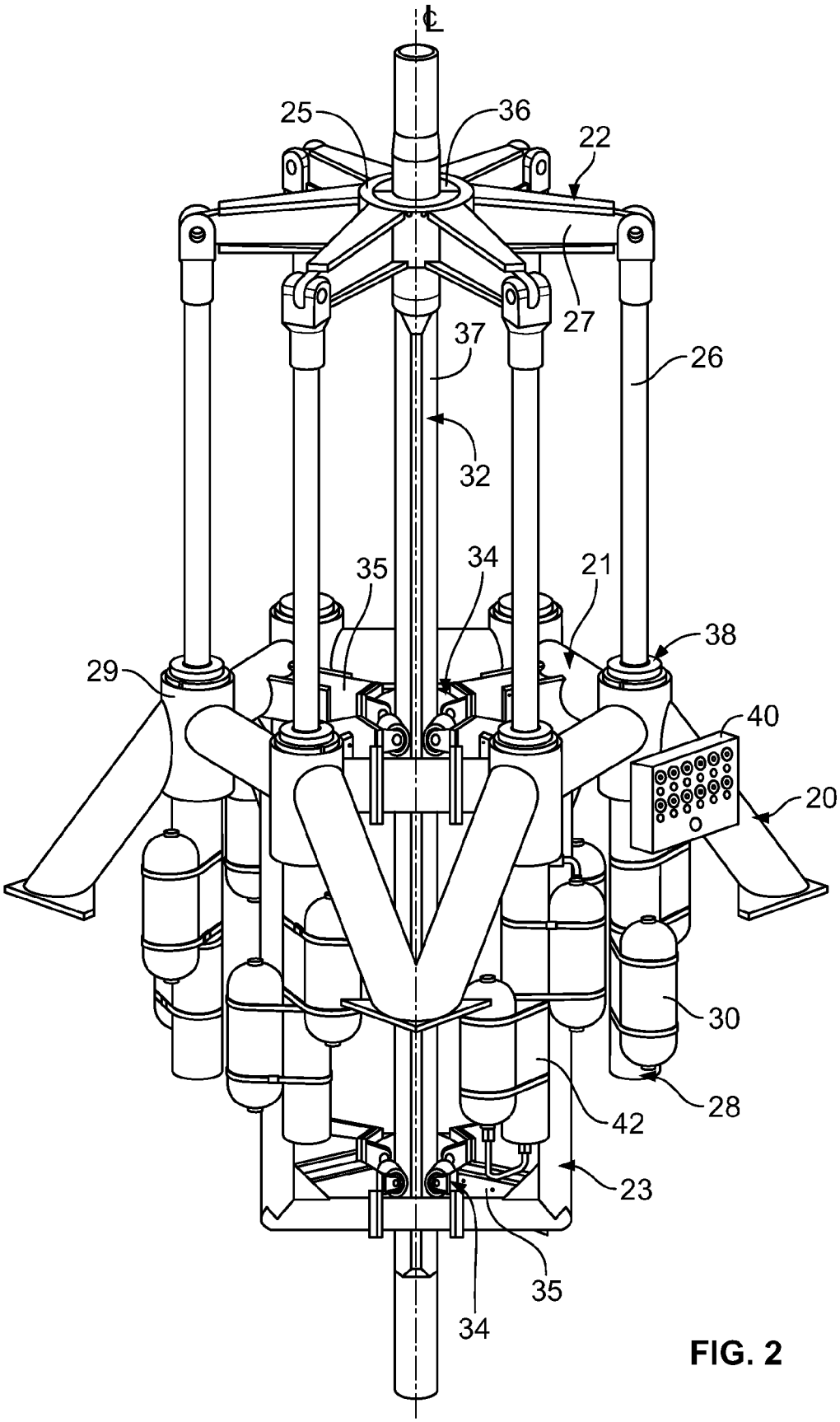
FIG. 2 is a side perspective view of an example riser tensioner system.

FIG. 2 depicts an example ram riser tensioner system 10' that can be used as ram riser tensioner system 10. The example ram riser tensioner system 10' has a riser tensioner with a frame 20, a plurality of ram pistons 28 (six shown, but fewer or more could be used), and a riser engaging collar 22. An elongate riser joint 32 is provided with the system 10' to couple with the remainder of the riser (e.g., by box and pin threaded connection and/or otherwise) in a location proximate the riser tensioner, and become a part of the riser. The frame 20 functions to affix the riser tensioner system 10' to the vessel 12 and to support the plurality of ram pistons 28, which extend axially, substantially parallel to a longitudinal axis of the riser, to support the riser in tension. The ram pistons 28 are coupled to the elongate riser joint 32 which, in turn, is coupled with the remainder of the riser.

The frame 20 is constructed of tubing and is shaped to affix to the vessel 12. In other instances, the frame 20 could be of another construction. The frame 20 has an upper ring portion 21 with a plurality of cylindrical ram piston receiving sleeves 29. The sleeves 29 receive the plurality of ram pistons 28. The sleeves 29 are longitudinally oriented, substantially parallel to the longitudinal axis of the riser.

The frame 20 has a lower frame portion 23 axially spaced apart from the upper ring portion 21. The upper ring portion 21 and the lower frame portion 23 each carry a plurality of centralizing arms 34 having rollers, bumpers, and/or other arrangement at their ends. As will be described in more detail below, the centralizing arms 34 abut the riser joint 32 with the rollers or other arrangement at their ends and laterally and rotationally constrain the riser joint 32 (and thus the riser) while allowing the riser joint 32 to move axially relative to the frame 20. An upper riser receiving opening is defined by the interior perimeter of the upper ring portion 21, and a lower riser receiving opening is defined by the lower frame portion 23. One set of centralizing arms 34 (four shown, but fewer or more could be provided) is arranged about the upper riser receiving opening. Another one set of centralizing arms 34 (four shown, but fewer or more could be provided) is arranged about the lower riser receiving opening. In other instances, additional sets of centralizing arms 34 could be provided axially spaced from the first or second set of centralizing arms.

The plurality of ram pistons 28 engage the riser joint 32 via a riser engaging collar 22. The riser engaging collar 22 grips the elongate riser joint 32 by using a wedge-shaped slip cavity 25 that mates with an inverse wedge-shaped slip ring 36 that engages the riser joint 32. The inverse wedge-shaped slip ring 36 has two half parts; each as a wedge cross-section that is thicker on top and tapered down toward the bottom. The slip ring 36 is mated to the riser joint 32 with a tooth profile on the exterior surface of the riser joint 32 and interior surface of the slip ring 36. The interface of the slip ring 36 and the riser joint 32 grips the riser joint 32 so that the riser cannot move downward relative to the riser engaging collar 22.

The ram pistons 28 have piston rods 26 extending from cylinders 42. In certain instances, the cylinders are hydro pneumatic, pressurized with both liquid and gas. However, the cylinders could be otherwise pressurized, for example, with only gas or only liquid. The piston rods 26 are coupled to a plurality of outwardly extending arms 27 of the riser engaging collar 22 at a movable connection, such as a clevis and tang, ball joint, pin joint, and/or other moveable connection. The cylinders 42 are internally pressurized to bias the piston rods 26 axially outward to support the riser engaging collar 22 axially. In certain instances, the cylinders 42 are provided with accumulators 30 that store fluid pressure.

The pressure in the cylinders 42 can be regulated via a control panel 40. The control panel 40 includes an arrangement of pressure gages displaying the pressure in the cylinders 42 and an arrangement of valves that allow pressure to be individually increased (added) or decreased (released from) in each of cylinders 42. Using the control panel 40 an operator can equalize the pressure in each of the cylinders 42 and regulate the upward support supplied by the ram pistons 28 to the riser.

Figure 3:
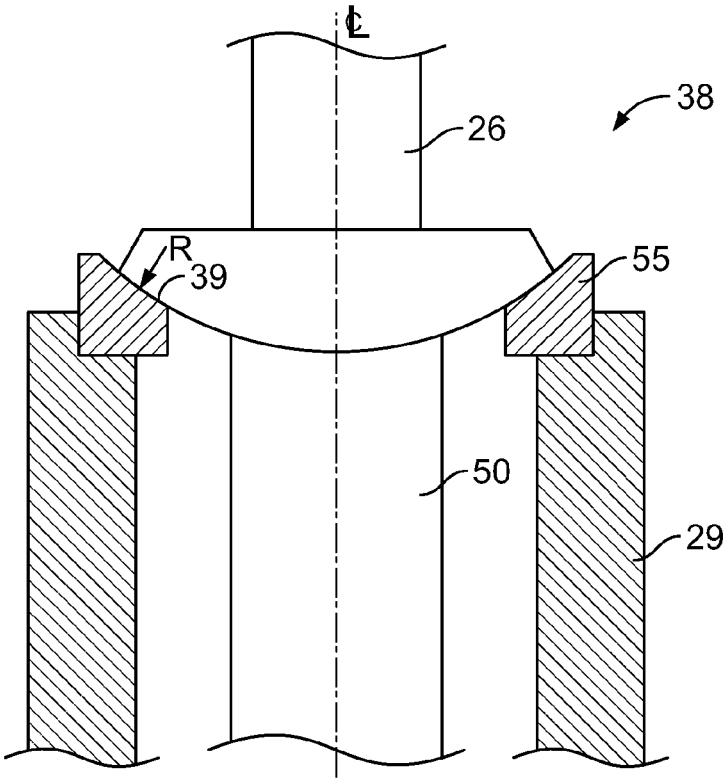
FIG. 3 is a detailed side cross-sectional view of an example misalignment assembly.

The cylinders 42 are coupled to the frame 20 using misalignment assemblies 38 that allow the cylinders 42 to move relative to the frame 20. In certain instances, the misalignment assemblies 38 can be a mechanical coupling between the cylinders 42 and the frame 20 that allows misalignment, an elastomeric pad between the cylinders 42 and the frame 20 that flexes in allowing misalignment, and/or another configuration of misalignment assembly. FIG. 3 shows one example of a mechanical coupling that can be used as a misalignment assembly 38. FIG. 3 shows a curved support surface 55 affixed to the exterior housing 50 of the cylinder 42. The curved support surface 55 mates with and is carried by a corresponding mating surface 39 on the frame 20 about the upper end of the sleeve 29. In certain instances, the curved support surface 39 and mating curved supporting surface 39 can have one surface being convexly semi-spherical and the other being concavely semi-spherical. However, other shapes can be used, including semi-cylindrical surfaces and/or another configuration. The inner diameter of the sleeve 29 is greater than the outer diameter of the exterior housing of the cylinder 42. Thus, when the curved support surface 39 and the curved mating surface 39 are mated, the misalignment assemblies 38 upwardly support the ram pistons 28 while allowing misalignment of the pistons 28 relative to the frame 20. For example, in an instance where the support surface 39 and mating support surface 39 are semi-spherical, the central, longitudinal axis of the ram pistons 28 can misalign to form an acute angle with the central longitudinal axis of the sleeves 29 (and thus, with the longitudinal axis of the riser) in any lateral direction.

The provision of a misalignment assembly 38, in certain instances, allows longitudinal angular alignment of the riser joint 32 (and thus, riser) to be borne by the centralizer arms 34 rather than by the interface between the ram pistons 28 and the frame 20. Therefore, in certain instances, lateral loading that may cause premature wear or failure of the ram pistons 28 can be limited.

Figure 4:
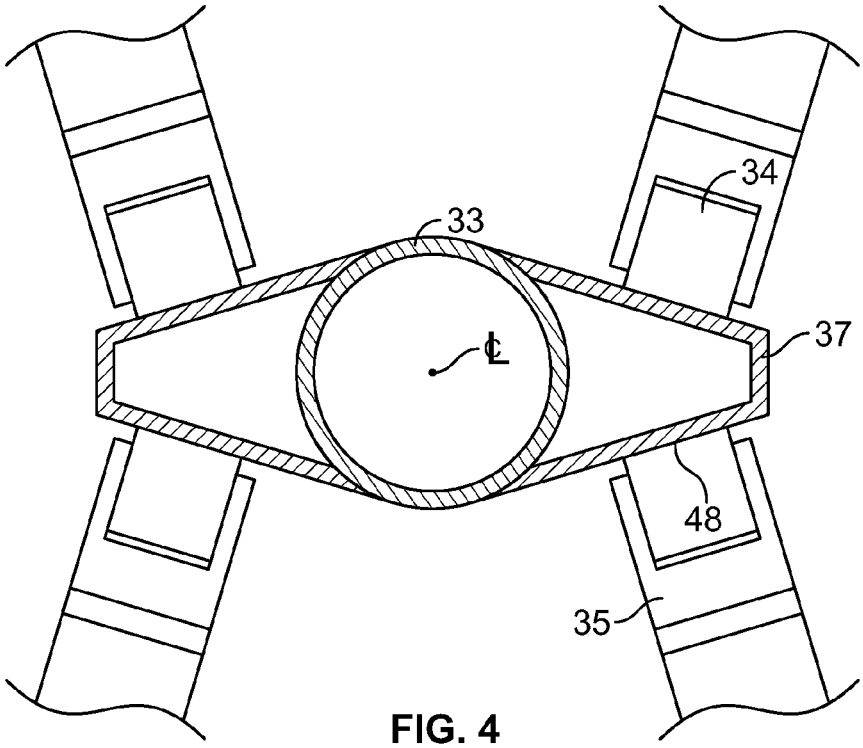
FIG. 4 is an axial cross-section view of an example riser joint.

As best seen in FIG. 4, an axial cross section of the riser joint 32, the riser joint 32 comprises a tubular flow portion 33 and elongate axial flanges 37. The tubular flow portion 33 of the riser joint 32 is a tube that can sealingly couple to the remainder of the riser (e.g., by box and pin threaded connection and/or otherwise) and communicate fluid flow with the remainder of the riser. The axial flanges 37 extend axially along a length of the riser joint 32 and project laterally outward on opposing sides of the tubular flow portion 33. Each of the axial flanges 37 is shown triangular shaped in axial cross-section. In other instances, the flanges 37 could be could be another shape, for example, thin and planar (e.g., constructed from a single sheet of plate metal), box shaped in axial cross-section, and/or other shape. The axial flanges 37 include centralizing arm engaging surfaces 48 oriented toward the centralizing arms 34, and the ends (e.g., rollers) of the centralizing arms 34 are arranged to reside in close proximity to or abut the centralizing arm engaging surfaces 48 to communicate constraining forces from the frame 20 to the riser joint 32. In instances where the axial flanges 37 are generally triangular in axial cross-section, the centralizer arm engaging surfaces 48 are substantially planar and define opposing sides of the generally triangular shape.

Referring back to FIG. 2, the centralizing arms 34 are arranged on the frame 20 to centralize the riser joint 32 in the upper riser receiving opening and lower riser receiving opening when the riser joint 32 is received through the riser receiving openings. Additionally, because the centralizing arms 34 are axially spaced, the centralizing arms 34 bear on the riser to maintain the riser joint 32 in a specified orientation, for example and as shown, substantially upright. Stated differently, the centralizing arms 34 maintain the longitudinal axis of the riser joint 32 (and thus, riser) relative (and preferably, though not necessarily, substantially parallel) to the longitudinal axis of the frame 20, as well as relative (and preferably, though not necessarily, substantially perpendicular) to the deck of the vessel. Because the centralizing arms 34 bear on the laterally protruding axial flanges 37, they can also counter rotation of the riser joint 32 relative to the frame 20 and vessel.

Each of the centralizing arms 34 has a laterally adjustable arm portion 35 attached to the frame 20 that enables the lateral position of the centralizing arm's end (e.g., rollers) to be adjusted relative to the center of the frame 20. By adjusting the lateral position of the centralizing arm 34, the amount of opening between the ends of the centralizing arms 34 can be adjusted to accommodate risers of various sizes, as well as the level of constraint applied to the riser (i.e., how tightly the riser is clamped between centralizing arms 34 and/or how much gap is provided between the riser and the ends of the centralizing arms 34).

Notably, because the riser tensioner system 10' acts directly on the riser, it need not incorporate a conductor (i.e., a large tubing that surrounds the riser to guide the tubing relative to the tensioner). As conductors are typically large, both diametrically and in length, in certain instances, the riser tensioner system 10' can be lighter and more compact than a tensioner system requiring a conductor. A lighter and more compact system is easier to transport, and because most vessels are space and weight constrained, better accommodated on the vessel.

A number of implementations have been described. Nevertheless, it will be understood that various modifications may be made. Accordingly, other implementations are within the scope of the following claims.

What is claimed is:

1. A riser tensioner system for tensioning a riser at an offshore vessel, comprising:

a frame adapted to affix to the vessel and defining a riser receiving opening; and an elongate axial flange coupled to and projecting laterally outward from a tubular flow portion of the riser and extending axially along a length of the riser; and a plurality of ram pistons arranged about the riser receiving opening and coupled to the frame, the ram pistons adapted to couple to the riser and be pressurized to extend axially to support the riser in tension; and a plurality of centralizer arms coupled to the frame and extending into proximity to the flange of the riser when the riser is received through the riser receiving opening, the plurality of centralizer arms comprising a first centralizer arm adapted to bear on a first side of the axial flange and a second centralizer arm adapted to bear on a second, opposing side of the axial flange to maintain the riser in a specified position relative to the frame and counter rotation of the riser on its longitudinal axis.

2. The riser tensioner system of claim 1, where one or more of the centralizer arms comprises a roller at an end of the arm proximate the flange of the riser.

3. The riser tensioner system of claim 1, where the plurality of centralizer arms comprise an upper plurality of centralizer arms and a lower plurality of centralizer arms, the lower plurality of centralizer arms spaced apart, axially along the length of the riser, from the upper plurality of centralizer arms.

4. The riser tensioner system of claim 1, where the flange comprises a substantially planar centralizer arm engaging surface oriented toward the first centralizer arm.

5. The riser tensioner system of claim 4, where the flange comprises a second substantially planar centralizer arm engaging surface; and wherein the first centralizer arm is adapted to bear on the first mentioned centralizer arm engaging surface and the second centralizer arm is adapted to bear on the second centralizer arm engaging surface.

6. The riser tensioner system of claim 5, where the flange is generally triangular in axial cross-section and the first mentioned centralizer arm engaging surface and the second centralizer arm engaging surface define opposing sides of the generally triangular shape.

7. The riser tensioner system of claim 1, where at least one of the plurality of ram pistons comprises a cylinder housing movably coupled to the frame to allow relative movement of the cylinder housing and the frame.

8. The riser tensioner system of claim 7, where the cylinder housing comprises a curved support surface; and where the frame comprises a curved mating surface adapted to mate with the curved support surface of the cylinder housing and, when the curved support surface and the curved mating surface are mated, allow the cylinder housing move relative to the frame.

9. The riser tensioner system of claim 8, where the curved support surface is semi-spherical.

10. The riser tensioner system of claim 1, where the plurality of centralizer arms are arranged to maintain a longitudinal axis of the riser substantially upright relative to the vessel when the riser is received through the riser receiving opening of the frame.

11. The riser tensioner system of claim 1, further comprising a riser engaging collar coupled to the ram pistons, the riser engaging collar adapted to grip the riser and couple the ram pistons to the riser.

12. The riser tensioner system of claim 1, wherein the elongate axial flange is affixed to the tubular flow portion of the riser.

13. The riser tensioner system of claim 1, wherein the plurality of centralizer arms comprise:

first and second centralizer arms that bear on respective first and second surfaces on the first side of the axial flange, the first surface being angled with respect to the second surface;

third and fourth centralizer arms that bear on respective third and fourth surfaces on the second side of the axial flange, the third surface being angled with respect to the fourth surface, and wherein the first, second, third, and fourth centralizer arms operate together, independent of any other centralizer arms, to maintain the riser in the specified position relative to the frame and counter rotation of the riser on its longitudinal axis.

14. The riser tensioner system of claim 1, wherein the all of the riser tensioner system's centralizing arms bear on the axial flange.

15. A method of supporting a riser relative to an offshore vessel, comprising:

gripping an outer surface of the riser and applying an upward force relative to the vessel, the upward force maintaining the riser in tension as the offshore vessel moves in response to environmental loading; and applying forces to opposing surfaces of an elongate, axial flange of the riser that protrudes laterally outward and maintaining the lateral location of the riser relative to the vessel and countering rotation of the riser on its longitudinal axis via the forces.

16. The method of claim 15, further comprising maintaining the riser substantially vertical via engaging the elongate axial flange of the riser.

17. The method of claim 15, where applying an upward force relative to the vessel maintaining the riser in tension comprises applying and upward force relative to the vessel with ram pistons pressurized to support the riser in tension and moveable relative to a frame supporting the pistons to allow misalignment of the ram pistons relative to the frame.

18. A riser tensioner for tensioning a riser having a laterally protruding, axial flange, the riser tensioner comprising:

a frame adapted to couple to a vessel;

a ram piston coupled to the frame, the ram piston adapted to couple to the riser and pressurized to extend axially and apply an upward force to the riser along a longitudinal axis of the riser to retain the riser in tension; and a plurality of centralizer arms protruding from the frame and adapted to abut the flange of the riser, the plurality of centralizer arms comprising a first centralizer arm adapted to bear on a first side of the axial flange and a second centralizer arm adapted to bear on a second, opposing side of the axial flange to maintain the riser in a specified position relative to the frame and counter rotation of the riser on its longitudinal axis.

19. The riser tensioner of claim 18, where the centralizer arms are arranged on the frame at different vertical locations, the centralizer arms adapted to abut vertically spaced apart locations on the surface of the flange in maintaining the riser in the specified position relative to the frame.

20. The riser tensioner of claim 19, where the ram piston is moveably coupled to the frame to allow misalignment of the pistons relative to the frame.

21. The riser tensioner of claim 20, wherein the ram piston comprises a semi-spherical support surface that mates with a semi-spherical mating surface on the frame to support the ram piston relative to the frame and allow misalignment of the pistons relative to the frame.

* * * * *